US010032430B2

(12) United States Patent
Huang et al.

(10) Patent No.: US 10,032,430 B2
(45) Date of Patent: Jul. 24, 2018

(54) PROCESSOR FOR USE IN DYNAMIC REFRESH RATE SWITCHING AND RELATED ELECTRONIC DEVICE

(71) Applicant: MEDIATEK INC., Hsin-Chu (TW)

(72) Inventors: Hao-Ting Huang, Hsinchu (TW); Chien-Chou Ko, Hsinchu (TW); Chang-Chu Liu, Hsinchu (TW); Shu-Wen Teng, Hsinchu (TW); Ta-Lun Huang, Hsinchu (TW); Chun-Wei Ku, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 14/850,923

(22) Filed: Sep. 10, 2015

(65) Prior Publication Data

US 2016/0078838 A1 Mar. 17, 2016

Related U.S. Application Data

(63) Continuation-in-part of application No. 14/831,879, filed on Aug. 21, 2015, now Pat. No. 9,905,199.
(Continued)

(51) Int. Cl.
*G09G 5/00* (2006.01)
*G09G 3/20* (2006.01)

(52) U.S. Cl.
CPC ..... *G09G 5/001* (2013.01); *G09G 3/20* (2013.01); *G09G 5/00* (2013.01);
(Continued)

(58) Field of Classification Search
None
See application file for complete search history.

(56) References Cited

U.S. PATENT DOCUMENTS 5,874,928 A 2/1999 Kou
7,671,873 B1 3/2010 Pierini et al.
(Continued)

FOREIGN PATENT DOCUMENTS

CN 103593155 A 2/2014
TW 201241739 A1 10/2012
(Continued)

OTHER PUBLICATIONS

State Intellectual Property Office, Second Office Action regarding Chinese Patent Application No. 201510593997.0, Mar. 23, 2018.

*Primary Examiner* — Xin Sheng
(74) *Attorney, Agent, or Firm* — Han IP Corporation; Andy M. Han

(57) ABSTRACT

A processor for use in an electronic device capable of displaying, having capability of switching a refresh rate for refreshing a display panel. The processor can dynamically transition between different states/scenarios in response to different triggering events. The processor can include an image stream consumer, configured to receive an input image stream and outputting an output image stream; a refresh rate selection controller, configured to select a refresh rate from a plurality of refresh rates in response to a monitoring of a current state/scenario; and a display controller, configured to receive the output image stream from the image stream consumer and transmit image data in the output image stream to a driving device, and in response to the selection by the refresh rate selection controller, control the driving device to refresh a display panel with the selected refresh rate.

63 Claims, 4 Drawing Sheets

Related U.S. Application Data

(60) Provisional application No. 62/051,328, filed on Sep. 17, 2014, provisional application No. 62/117,075, filed on Feb. 17, 2015.

(52) U.S. Cl.
CPC ..... *G09G 2330/021* (2013.01); *G09G 2340/0435* (2013.01); *G09G 2340/14* (2013.01); *G09G 2350/00* (2013.01); *G09G 2360/08* (2013.01); *G09G 2360/18* (2013.01)

(56) References Cited

U.S. PATENT DOCUMENTS 8,334,857 B1* 12/2012 Ogrinc ..... G09G 5/377 345/204
9,684,976 B2* 6/2017 Finkel ..... G06T 11/001
2004/0125099 A1* 7/2004 Stanley ..... G09G 5/00 345/211
2004/0252115 A1 12/2004 Boireau
2008/0055318 A1* 3/2008 Glen ..... G09G 3/20 345/501
2008/0100598 A1 5/2008 Juenger
2009/0150898 A1* 6/2009 Sohn ..... G06F 9/5066 718/105
2009/0252227 A1* 10/2009 NepomucenoLeung ..... H04N 19/107 375/240.13
2012/0068993 A1* 3/2012 Kambhatla ..... G09G 5/00 345/213
2012/0146968 A1 6/2012 Glen
2013/0021352 A1 1/2013 Wyatt et al.
2013/0141642 A1* 6/2013 Wu ..... G06F 3/1407 348/441
2013/0162550 A1* 6/2013 Chen ..... G06F 1/3262 345/173
2013/0187962 A1* 7/2013 Vieri ..... G09G 3/20 345/698
2013/0257752 A1 10/2013 Tripathi et al.
2013/0265294 A1 10/2013 Kim
2013/0278614 A1* 10/2013 Sultenfuss ..... G09G 3/3406 345/520
2014/0045543 A1 2/2014 Ishii et al.
2014/0160182 A1 6/2014 Hong et al.
2014/0168197 A1 6/2014 Kobayashi
2014/0368492 A1* 12/2014 Fujioka ..... G09G 3/3648 345/214
2015/0015591 A1 1/2015 Oh et al.
2015/0138212 A1 5/2015 Bae et al.
2015/0243253 A1 8/2015 Sone et al.

FOREIGN PATENT DOCUMENTS

TW 201314526 A1 4/2013
TW 201337536 A 9/2013

* cited by examiner

PROCESSOR FOR USE IN DYNAMIC REFRESH RATE SWITCHING AND RELATED ELECTRONIC DEVICE

CROSS REFERENCE TO RELATED APPLICATION

This application claims the benefit of U.S. Provisional Application No. 62/051,328, filed on Sep. 17, 2014, and U.S. Provisional Application No. 62/117,075, filed on Feb. 17, 2015. This application is also a continuation in part (CIP) of U.S. application Ser. No. 14/831,879, filed on Aug. 21, 2015, which claims the benefit of U.S. Provisional Application No. 62/051,328, filed on Sep. 17, 2014, and U.S. Provisional Application No. 62/117,075, filed on Feb. 17, 2015. The entire contents of the related applications are incorporated herein by reference.

BACKGROUND

The present disclosure relates to refresh rate switching, and more specifically, to a processor and an electronic device having the capability of dynamically switching a refresh rate of a display panel according to usage scenario, operation, and/or status of the processor and the electronic device.

A display device is periodically refreshed with images to be presented. In a typical display device, a driving device, such as display driver integrated chip (DDIC), receives image data of images to be presented from a graphic processor unit (GPU) or a display-related circuit that hosts the display device, and according to received image data, a timing controller in the driving device directs one or more source drivers and one or more gate drivers in the driving device to apply proper voltages to pixels of a display panel in the display device, thereby presenting the images. A rate at which the images change from one to another, or are refreshed, on the display panel is called refresh rate. This is normally identical to the rate at which the GPU or the display-related circuit updates a buffer circuit in the driving device.

Nowadays, the display device can be operated at high refresh rates, such as, 120 Hz, 240 Hz, or even higher, which is significantly higher than the refresh rate of 60 Hz on a traditional display device. High refresh rate can smooth out fast-moving contents, such as action movies or sporting events, on the display device, which leads to less motion blur and therefore great user's visual experience. However, high refresh rate also means high power consumption.

Sometimes, the display device may be incorporated in a compact and portable embedded computer system, such as smartphone, tablet, laptop, electronic book, and multimedia player. In such devices, electrical power is limited and exhaustible as provided by a battery, and the display device may consume a significant portion of the limited battery power. The high refresh rate of the display device makes the compact/portable electronic device struggle with the battery power since operations of the GPU or the display-related circuit updating the buffer circuit as well as the driving circuit driving the display panel drains lot of power from the battery. The higher the refresh rate, the more power the electronic device consumes.

Therefore, there is a need for providing a solution that can dynamically switch the refresh rate of the display device to meet different design requirement such as minimizing power consumption and/or to enhancing user's visual experience.

SUMMARY

Embodiments of the present disclosure provides a solution capable of meeting different design or operation requirements, such as guaranteeing user's visual experience in watching moving contents and/or minimizing power consumption. Embodiments of the present disclosure provide a processor that is able to dynamically switching a refresh rate of a display panel in an electronic device. In some embodiments, the display panel can be operable at a wide or selectable range of refresh rates. In addition, the processor can select a proper refresh rate according to current usage scenario, status and/or operations of the electronic device without having the user directly involved in. The processor could transition between a plurality of states/scenarios based on predetermined triggering events. The predetermined triggering events can be caused by information provided by modules internal or external to the processor. Accordingly, the refresh rate for refreshing the display panel could be determined based on the current state/scenario.

According to one embodiment of the present invention, a processor for use in an electronic device capable of displaying has the capability of switching a refresh rate for refreshing a display panel. The processor comprises: an image stream consumer, a refresh rate selection controller and a display controller. The image stream consumer is configured to receive an input image stream and outputting an output image stream. The refresh rate selection controller is configured to select a refresh rate from a plurality of refresh rates in response to a monitoring of a current state/scenario, wherein the processor dynamically transitions between different states/scenarios in response to different triggering events. The display controller is configured to receive the output image stream from the image stream consumer and transmit image data in the output image stream to a driving device, and in response to the selection by the refresh rate selection controller, control the driving device to refresh a display panel with the selected refresh rate.

According to one embodiment of the present invention, an electronic device that is capable of displaying has the capability of switching a refresh rate for refreshing a display panel. The electronic device comprises: a display panel, a processor and a driving device. The display panel is capable of display frames with a plurality of a refresh rates. The processor is configured to dynamically transition between different states/scenarios in response to different triggering events and to select a refresh rate from the plurality of refresh rates in response to a monitoring of a current state/scenario. The driving device is coupled between the processor and the display panel, and controlled by the processor to refresh the display panel with the selected refresh rate.

According to one embodiment of the present invention, a processor is employed for use in an electronic device that is capable of displaying. The processor has the capability of switching a refresh rate for refreshing a display panel, and comprises: a refresh rate selection controller and a display controller. The refresh rate selection controller is configured to dynamically adjust a refresh rate for refreshing the display panel when a power-related triggering event occurs. The display controller is configured to control a driving device to refresh a display panel with the adjusted refresh rate.

According to one embodiment of the present invention, an electronic device that is capable of displaying has the capability of switching a refresh rate for refreshing a display panel. The electronic device comprises: a display panel, a processor and a driving device. The display panel is capable of display frames. The processor is configured to dynamically adjust a refresh rate for refreshing the panel when a power-related triggering event occurs. The driving device is coupled between the processor and the display panel, and controlled by the processor to refresh the display panel with the adjusted refresh rate.

According to one embodiment of the present invention, a processor for use in an electronic device capable of displaying, having capability of switching a refresh rate for refreshing a display panel, comprising: an image stream consumer, configured to receive an input image stream and output an output image stream; a refresh rate selection controller, configured to select a refresh rate from a plurality of refresh rates in response to different triggering events, the different trigger events including at least one of a low power event, a multimedia event, a touch event, and a frame rate monitoring/limitation event for the input image stream; and a display controller, configured to receive the output image stream from the image stream consumer and transmit image data in the output image stream to a driving device, and in response to the selection by the refresh rate selection controller, control the driving device to refresh the display panel with the selected refresh rate.

In the embodiments, the plurality refresh rates can be dynamically selected without a direct setting of the refresh rate by a user. Moreover, a suitable refresh rate can be selected for the current usage scenario. In comparison, the conventional art does not allow the refresh rate of a display panel to be dynamically changed or adjusted according to certain events, such as power-related event, touch-related event, and/or multimedia-related event. Consequently, the embodiments of the present disclosure can meet various design or operation requirements such as minimizing power consumption in refreshing the display panel, increasing power efficiency or reducing waste of power consumption, and/or enhancing user's visual experience for example in motion blur.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
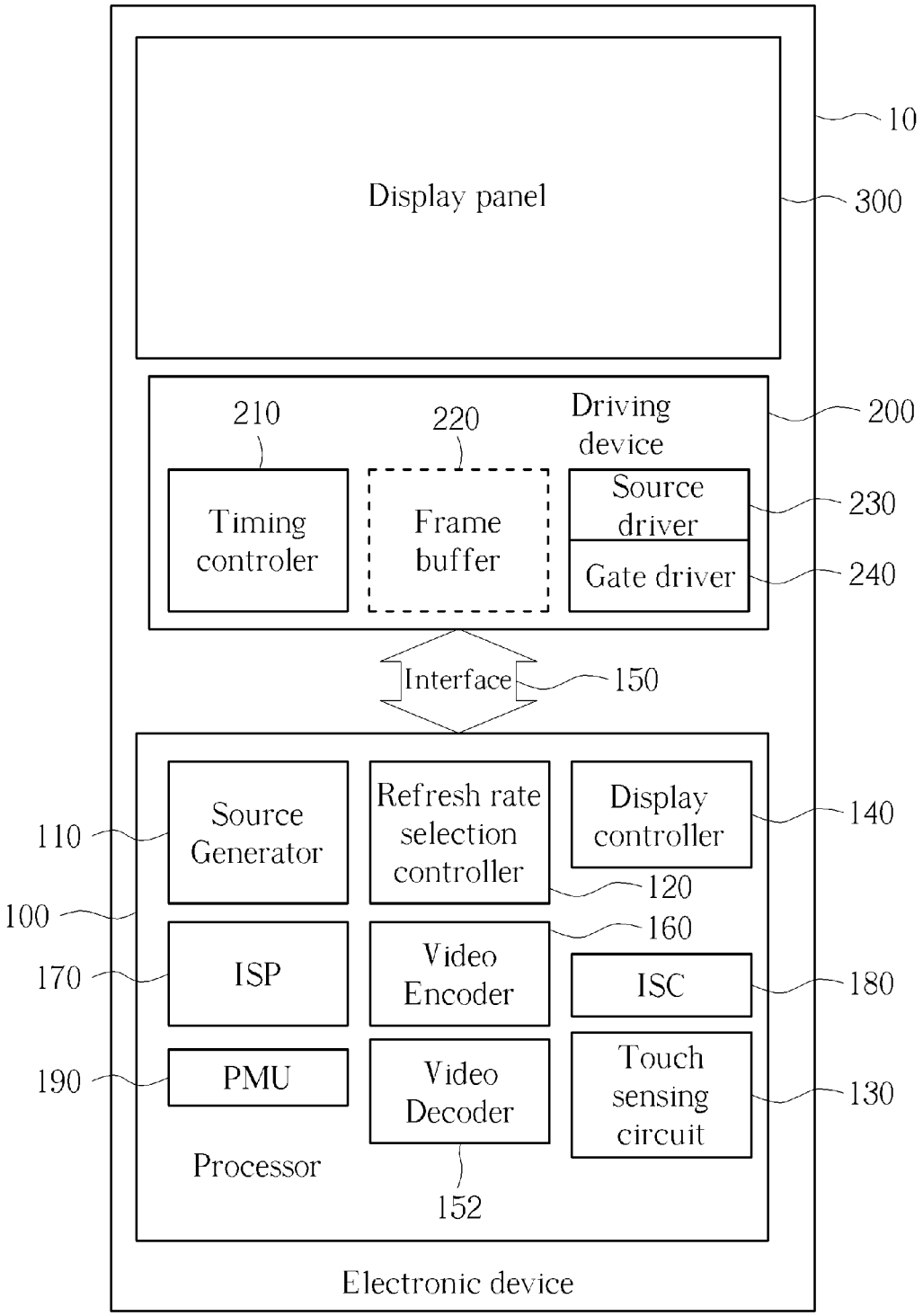
FIG. 1 illustrates a block diagram of an electronic device that incorporates the aspects of the present invention according to an embodiment.

Certain terms are used throughout the following descriptions and claims to refer to particular system components. As one skilled in the art will appreciate, manufacturers may refer to a component by different names. This document does not intend to distinguish between components that differ in name but not differ in function. In the following discussion and in the claims, the terms "include", "including", "comprise", and "comprising" are used in an open-ended fashion, and thus should be interpreted to mean "including, but not limited to . . . ." The terms "couple" and "coupled" are intended to mean either an indirect or a direct electrical connection. Thus, if a first device couples to a second device, that connection may be through a direct electrical connection, or through an indirect electrical connection via other devices and connections.

It is noted that the term "scenario/state" used in the disclosure can mean either or both of one or more scenarios and one or more states. The term "state" can mean an operational state or a specific condition described for a system or at least a component thereof. The term "scenario" can refers to "usage scenario," which can indicate the way the system is operated by its user, and/or the processing tasks the system carries out during operation. The term "scenario" can also mean any operation conditions and activities of the system.

Embodiments of the disclosure provide a processor for use in an electronic device capable of displaying. The processor has a capability of switching a refresh rate for refreshing a display panel. The processor can dynamically transition between different states/scenarios in response to different triggering events and selects an appropriate refresh rate for refreshing a display panel according to a current state/scenario among the different states/scenarios. Other embodiments also provide an electronic device capable of displaying, having capability of switching a refresh rate for refreshing a display panel.

In some specific implementations, the processor can include an image stream consumer, configured to receive an input image stream and output an output image stream, a refresh rate selection controller, configured to select a refresh rate from a plurality of refresh rates in response to a monitoring of a current state/scenario, and a display controller, configured to receive the output image stream from the image stream consumer and transmit image data in the output image stream to a driving device. Based on the selection by the refresh rate selection controller, the display controller can control the driving device to refresh the display panel with the selected refresh rate.

In one embodiment, each of the states/scenarios corresponds to one or more refresh rates of the refresh rates, and the refresh rate selection controller selects one of the one or more refresh rates to which a current state/scenario corresponds. In other words, one or more refresh rates can be predetermined to be suitable for each of the possible states/scenarios, respectively. Accordingly, regardless of the current state/scenario, the display panel can be refreshed with a refresh rate which is predetermined to be suitable for the current state/scenario.

The states/scenarios can be various required by different designs. For example, the states/scenarios can be designed to include at least one of a low power state/scenario, one or more multimedia states/scenarios, and one or more non-multimedia states/scenarios which may include an idle state/scenario and one or more non-idle states/scenarios. Moreover, to trigger the processor to transition between the states/scenarios, at least one of a low power event, a non-low power event, one or more multimedia events, and/or one or more multimedia stopped events can be detected. In such implementations, occurrence of various events can trigger the processor to leave one state/scenario and transition to another state/scenario, further causing the processor to dynamically select a refresh rate predetermined to be suitable for the current state/scenario.

Embodiments of the disclosure also provide a processor for use in an electronic device capable of displaying. The processor has capability of switching a refresh rate for refreshing a display panel which may be implemented in the electronic device. The processor can dynamically adjust a refresh rate for refreshing the display panel when a power-related triggering event occurs and control a driving device to refresh the display panel with the adjusted refresh rate.

Processor and Electronic Device

FIG. 1 illustrates an electronic device incorporating aspects of the present invention according to an embodiment. As illustrated, an electronic device 10 comprises: a processor 100, a driving device 200 and a display panel 300. The processor 100 could be implemented with a general-purpose processor, a dedicated processor or even an application processor. The display panel 300 could be a flat-panel, such as plasma panel, OLED panel, or TFT LCD panel. Preferably, the display panel 300 may further have touch driving and sensing electrodes thereon (not shown) and provides the functionality of touch sensing.

The display panel 300 is operable to display images with an alterable refresh rate. Preferably, the display panel 300 is dynamically selected to be refreshed with one of a plurality of possible refresh rates. The driving device 200 is coupled to the display panel 300 and configured to drive the display panel 300 at any of possible refresh rates. In various embodiments, the display panel 300 could be driven by the driving device 200 at the refresh rate of 30 Hz, 60 Hz, 120 Hz or even higher to display images. The driving device 200 comprises a timing controller 210, a (optionally implemented) buffer circuit 220 such as a GRAM and one or more source drivers 230 and one or more gate drivers 240.

The processor 100 comprises (but not limited to) a refresh rate selection controller 120, a display controller 140 and an image stream consumer (ISC) 180. The processor 100 can dynamically transition between different states/scenarios in response to different triggering events. The refresh rate selection controller 120 is configured to select one from a plurality of refresh rates in response to a monitoring of a current state/scenario. The ISC 180 is configured to receive an input image stream and output an output image stream. The display controller 140 is configured to receive the output image stream from the ISC 180 and transmit image data in the output image stream to the driving device 200. In response to the selection by the refresh rate selection controller 120, the display controller 140 controls the driving device 200 to refresh a display panel with the selected refresh rate.

In order to meet different design requirements, such as minimizing the power and/or improving user's visual experience (e.g., less motion blur), the different states/scenarios and related triggering events (which will be illustrated later in further details) for the processor 100 can be configured such that the refresh rate selection controller 120 can select a refresh rate that is suitable for current state/scenario indicate current usage scenarios, status, operations of the electronic device 10 or the processor 100.

Preferably, each of the states/scenarios corresponds to one or more refresh rates. When the processor 100 transition to a certain state/scenario, the refresh rate selection controller 120 selects one of the refresh rates corresponding to the state/scenario that the processor 100 is currently in.

Moreover, after a certain refresh rate is selected, one or more control signal such as a timing control signal and/or a command signal may be used to control the driving device 200 to drive the display panel 300 with the selected refresh rate. In addition, the display controller 140 may adjust transmission rate of image data via the interface 150 to the driving device 200 to support or adapt to the change of the refresh rate. In some embodiments, either or both of video mode and command mode can be implemented, as will be explained more below.

Adjustment on Refreshing of Display Panel

According to one embodiment, the refresh rate of the display panel 300 can be dynamically adjusted in a video mode. In the video mode, the display controller 140 allows the driving device 200 to change the refresh rate by sending a timing control signal. Preferably, the timing control signal is a V-sync signal. After the refresh rate selection controller 120 selects a certain refresh rate, the display controller 140 changes a frequency of the V-sync signal to be identical to the selected refresh rate. Accordingly, the driving device 200 instructs the timing controller 210 to control the source drivers 230 and the gate driver 240 to drive the display panel 300 at the selected refresh rate.

According to another embodiment, the refresh rate of the display panel 300 can be dynamically selected in a command mode. In the command mode, the display controller 140 sends a command to the driving device 200 for directing the driving device 200 to refresh the display panel 300 with the selected refresh rate. In addition, the driving device 200 further sends a timing control signal, which preferably is a tearing effect (TE) signal, to the display controller 140. According to the TE signal, the display controller 140 can determine whether to update the buffer circuit 220.

Adjustment on Data Transmission Rate

No matter in the vide mode or the command mode, after the refresh rate is increased/decreased, the display controller 140 can determine whether to provide more/less images or refreshing the buffer circuit 220 more/less times in a unit of period.

According to various embodiments of the present invention, multiple ways of adjusting the data transmission rate are provided. In one embodiment, the display controller 140 adjusts a clock rate of a clock used for transmitting image data over the interface 150 to adjusting the data transmission rate. In another embodiment, a blanking/idle period between consecutive images can be shortened to increase the data transmission rate over the interface 150. In still another embodiment, the adjustment on the data transmission rate can be achieved by the display controller 140 controlling a number of active data transmission paths over the interface 150. In yet another embodiment, the adjustment on the data transmission rate can be achieved by adjusting a compression rate of an image data compression process.

Selection of the Refresh Rate

The refresh rate selection controller 120 could select the refresh rates in response to monitoring of the current state/scenario. The processor 100 could transition between states/scenarios mainly based on information regarding a current state/scenario. The information regarding the current state/scenario may indicate a current usage scenario, status, operations of the processor 100 or part or whole of the electronic device 10. Such information can be derived from certain modules inside or externally coupled to the processor 100.

In some embodiments, the information indicates whether any of one or more predetermined triggering events occurs and triggers the processor 100 to transition to a certain state/scenario. Some of the states/scenarios cause the refresh rate selection controller 120 to select a higher refresh rate than a previous one, while some of the states/scenarios cause the refresh rate selection controller 120 to select a lower refresh rate than a previous one. Predetermined triggering events causing the processor 100 to transition to a different state/scenario comprises (but not limited to): web browsing, an execution of a high quality video game, a high quality video playback, a touch event, a low power event, a system status, and/or an increased/decreased frame rate of an image/video stream processed by the processor 100 or provided by application software running on the electronic device 10.

States/Scenarios and Related Triggering Events

Figure 2:
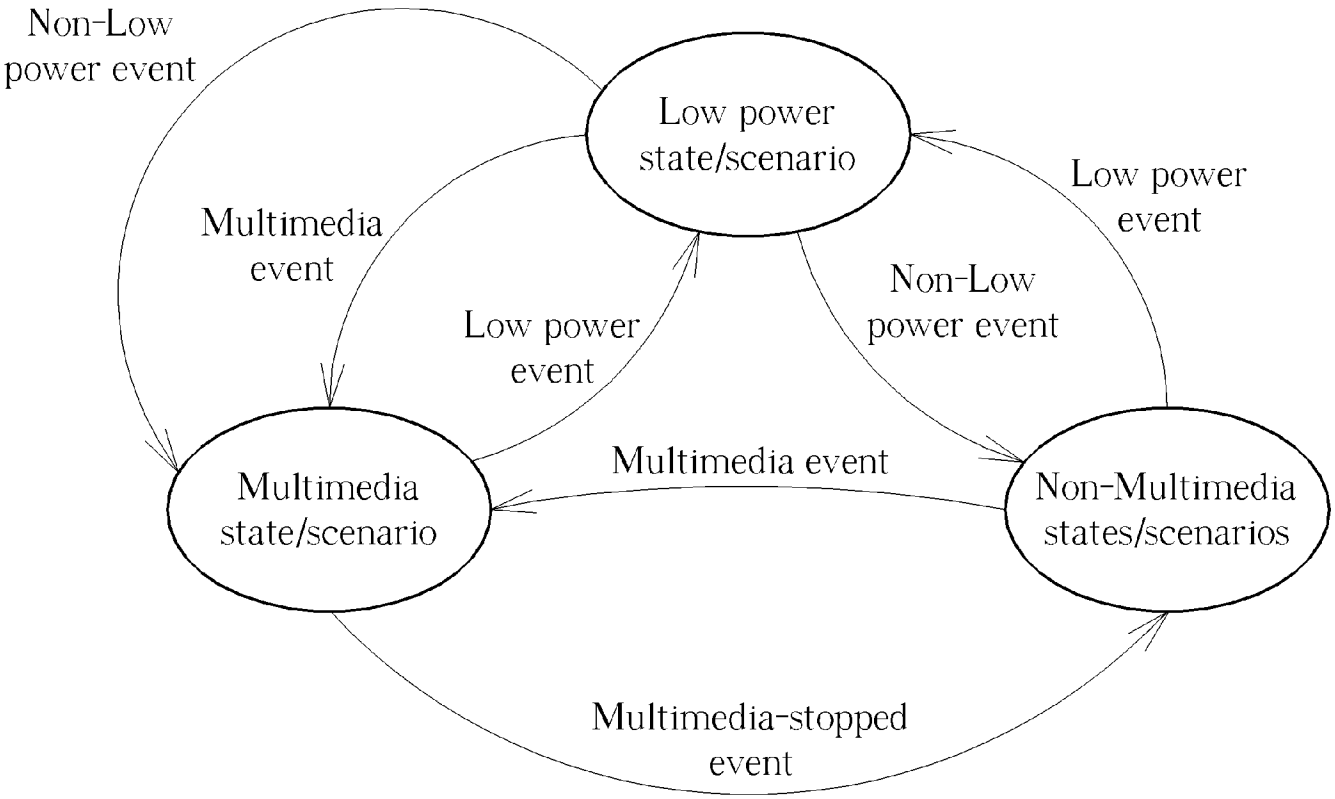
FIG. 2 illustrates multiple states/scenarios and related triggering event to trigger the processor to transition between the states/scenarios according to one embodiment of the present invention.

As mentioned above, the processor 100 transitions between different states/scenarios. FIG. 2 illustrates three basic types of states/scenarios and related triggering events for triggering the processor 100 to transition to a certain state/scenario. FIG. 2 is explained with the electronic device 10 in FIG. 1 but is not limited thereto. The basic types of the states/scenarios include a low power state/scenario, a multimedia state/scenario, and one or more non-multimedia states/scenarios. It is noted that in other embodiments, only a part of the basic types of the states/scenarios can be implemented.

In one embodiment, a low power event can trigger the processor 100 transition from the multimedia state/scenario or the non-multimedia state/scenario to the low power state/scenario. In other words, regardless of which state/scenario of processor 100 is originally in, once a low power event occurs, the processor 100 can transition to the low power state/scenario.

Conversely, a non-low power event (e.g. normal power), can trigger the processor 100 to leave the low power state/scenario and further transition to the non-multimedia states/scenarios. In some other implementations, when a non-low power event and a multimedia event simultaneously occur, after leaving the low power state/scenario, the processor 100 can transition to the multi-media state/scenario. In some implementations, even if a non-low power event and a multimedia event simultaneously occur, after leaving the low power state/scenario, the processor 100 can transition to the non-multimedia state/scenario and then transition to the multimedia state/scenario.

Furthermore, a multimedia event can trigger the processor 100 transition from the non-multimedia state/scenario to the multimedia state/scenario. As described, in some implementations, simultaneous occurrences of a multimedia event and a non-low power event may trigger the processor 100 transition from the low power state/scenario to the multimedia state/scenario.

Conversely, a multimedia-stopped event can trigger the processor 100 to transition from the multimedia state/scenario to one of the one or more non-multimedia states/scenarios. The following descriptions will elaborates these states/scenarios, triggering events, selecting of the refresh rates in certain states/scenarios, and corresponding modifications in further details.

Low Power State/Scenario and Related Events

Power level information provided by a power management unit (PMU) 190 in FIG. 1 could lead to the low power event to occur. In response to the low power event, the processor 100 will transition to the low power state/scenario. In the low power state/scenario, the refresh rate selection controller 120 could select one of relatively low refresh rate to reduce the power consumption. Preferably, the refresh rate selection controller 120 could select the lowest refresh rate of the plurality of refresh rates that the display panel 300 is operable at. It is noted that, the refresh rate selection controller 120 does not need to select a lowest refresh rate, which means the refresh rate selection controller 120 could select a relatively high refresh rate to guarantee user's visual experience.

According to various embodiments of the present invention, the PMU 190 could be inside the processor 100 or externally coupled to the processor 100, which monitors a power level of a power source (e.g. Lithium-ion battery) that supplies power to part or whole components of the electronic device 10, e.g., the processor 100, the driving device 200, the display panel 300 or even the whole electronic device 10. For example, when the power level is indicated lower than a power threshold level, the PMU 190 could determine that the low power event to occur.

In other words, the power level information provided by the PMU 190 could lead to a low power event. It is noted that, in other embodiments, in addition or as an alternative to the power level information provided by the PMU 190, a request for lowering power consumption of the electronic device 10 or any components thereof could also lead to the low power event. The request could be sent by any modules including the PMU 190 that is internal or external to or the processor 100 or OS running on the electronic device 10.

Conversely, either or both of the power level information provided by the PMU 190 or any request for increasing the power consumption of the electronic device 10 or any components thereof could lead to a non-low power event. In response to the non-low power event, the processor 100 will leave the low power state/scenario.

It is noted although the low power state/scenario is illustrated as a single state/scenario in the embodiment, the low power state/scenario may implemented as multiple states/scenarios corresponding to different refresh rates. And correspondingly, the low power event may include multiple different events for triggering the processor 100 to transition to the multiple states/scenarios, respectively. For example, different low power levels may trigger the processor 100 to transition to different low power states/scenarios, further causing the display panel 300 to be refreshed with different refresh rates.

As such, the power consumption could be reduced when the PMU 190 detects the electrical power is at a low level or one of multiple levels. In addition, the user's visual experience may be guaranteed because when electrical power is at or back to a higher level (e.g. higher than the power threshold level), the processor 100 can be at or transition to another state/scenario, further causing the display panel to be refreshed with a new refresh rate suitable for the another state/scenario.

Multimedia State/Scenario and Related Events

According to various embodiments of the present invention, several operations of the electronic device 10 will lead to the multimedia event. In response to the multimedia event, the processor 100 can transition to the multimedia state/scenario. In different implementations, either or all of video playback, video recording and camera preview operations executing on the electronic device 10 could cause the multimedia event.

A video decoder 152 that is internal to the processor 100 or external to the processor 100 could indicate the video playback operation when it performs video decoding process, thereby causing the multimedia event.

A video encoder 160 that is internal to the AP 100 or external to the processor 100 could indicate the video recording operation when it performs video encoding process, thereby causing the multimedia event.

An image signal processor (ISP) 170 that is internal to the processor 100 or external to the processor 100 could indicate the camera preview operation when it provides preview stream to be presented to the user, thereby causing the multimedia event.

According to various embodiments of the present invention, the multimedia state/scenario corresponds to a refresh rate of 30 Hz, 60 Hz or both. In one embodiment, when the multimedia event occurs, the refresh rate selection controller 120 could select the same refresh rate regardless of whether the multimedia event is a video playback, a video recording or a camera preview operation and what frame rate an input image frame is. In other words, once the processor 100 transition to the multimedia state/scenario, the refresh rate selection controller 120 can always select a fixed refresh rate (e.g., 60 Hz) for refreshing the display panel 300.

In another embodiment, the refresh rate selection controller 120 could select one of multiple refresh rates according to the actual multimedia operation that is performed by the processor 100 or the electronic device 10. Preferably, the refresh rate selection controller 120 can select a refresh rate that is suitable for an actual application. For example, the multimedia event caused by video recording and camera preview operations will lead to selecting a refresh rate at 30 Hz because presenting contents regarding video recording and camera preview at the low refresh rate such as 30 Hz normally does not degrade user's visual experience. Hence, in the camera preview and video recording operation, the processor 100 selects a moderate refresh rate other than a highest refresh rate to save power consumption. On the other hand, for the multimedia events caused by video playback operations, the refresh rate selection controller 120 could select a refresh rate (30 Hz or 60 Hz) or one from multiple refresh such as 30 Hz and 60 Hz. This selection is primarily because too high refresh rate normally does not bring obvious advantages to user's visual experience but consume much more power. Another reason is because an original frame rate of the image stream to be played may not exceed 60 fps. In other words, the refresh rate selection controller 120 preferably does not select a highest refresh rate for a multimedia event from all the refresh rates that the display panel 300 is operable at, such as 120 Hz from 60 Hz and 120 Hz (or 30 Hz, 60 Hz and 120 Hz).

It is noted although the multimedia state/scenario is illustrated as a single state/scenario in the embodiment, the multimedia state/scenario may implemented as multiple states/scenarios corresponding to different refresh rates. And correspondingly, the multimedia event may include multiple different events for triggering the processor 100 to transition to the multiple states/scenarios, respectively. For example, different types of multimedia events and/or different frames rates of an input image stream may trigger the processor 100 to transition to different multimedia states/scenarios, further causing the display panel 300 to be refreshed with different refresh rates.

In addition to the above-mentioned operations in which the refresh rate selection controller 120 is informed by other modules of occurrence of a multimedia event, the refresh rate selection controller 120 could also determines whether the multimedia event occurs. In an embodiment, the refresh rate selection controller 120 can make the determination according to a frame rate of the input image stream calculated by the ISC 180 and whether the input image stream is encoded in a specific color format, such as a YUV color format. Typically, when the frame rate of an image stream is stable non-zero and the image stream is encoded in YUV color format, this means the image stream could be the product of the video playback operation, video recording operation or camera preview operation. Therefore, the refresh rate selection controller 120 can determine the multimedia event occurs, which triggers the processor 100 can to transition to the multimedia state/scenario. Subsequently, the refresh rate selection controller 120 selects the refresh rate corresponding to the multimedia state/scenario, e.g., 30 Hz or 60 Hz.

On other hand, once the multimedia event is stopped, a multimedia stopped event occurs, which could cause the processor 100 to leave the multimedia state/scenario. In some implementations, after leaving the multimedia state/scenario, the processor 100 can transition to a non-multimedia state/scenario or one of multiple non-multimedia sates. The multimedia stopped event could be generated if the above-mentioned operations (e.g. video playback, video recording, or camera preview) are detected stopped.

Non-Multimedia States/Scenarios and Related Events

One or more non-multimedia states/scenarios can be configured for the processor 100. The one or more non-multimedia states/scenarios can comprise an idle state/scenario and one or more non-idle states/scenarios, which can be transitioned to based on the following triggering events, respectively.

Touch Related Events

When an object or a user's finger is brought in proximity of the display panel 300 is detected, a touch event occurs. A touch sensing circuit 130 that is inside the processor 100 or externally coupled to the processor 100 could detect the touch event. It is assumed that the processor 100 is originally in the idle state/scenario or other states/scenarios (e.g. low power state/scenario or the multimedia state/scenario). If a touch event occurs, in response to the touch event, the processor 100 may transition from the idle state/scenario to a non-idle state/scenario.

For the non-idle state/scenario caused by the touch event, the refresh rate selection controller 120 could select a relatively higher or even the highest refresh rate of all the refresh rates that the display panel 300 is operable at. This is because the touch event may be followed by a touch-slide operation (which may occur when the user is doing web-browsing, or interacting with the user interface) on the display panel 300, which further causes moving contents to be presented on the display panel 300. In order to smooth out the moving contents and reduce the motion blur, the refresh rate selection controller 120 could select higher or the highest refresh rate.

On the other hand, the touch sensing circuit 130 could also cause a touch-leaving event to occur when detecting an object or a user's finger is brought away from the display panel 300. When the touch-leaving event occurs, the processor 100 could transition from the non-idle state/scenario to the idle state/scenario. For the idle state/scenario caused by the touch-leaving event, the refresh rate selection controller 120 could select a relatively lower or lowest refresh rate other than the highest refresh rate of all the refresh rates that the display panel 300 is operable at since the images may not include moving contents at this moment.

Frame Rate Monitoring/Limitation Events

The selection of the refresh rate may be related to monitoring of a frame rate of the input image stream or limitation to a frame rate of the input image stream to be presented. In some embodiments, the selection of the refresh rate may be related to a frame rate monitoring/limitation event whose occurrence can trigger the processor to select a suitable refresh rate according to a monitored/limited refresh rate.

In such embodiments capable of reacting to a frame rate monitoring/limitation event, the refresh rate selection controller 120 may be informed of the frame rate by the ISC 180 which can analyze the frame rate of an input image stream processed by the processor 100.

In one embodiment, the processor 100 could further comprise a source generator 110. Alternatively, the source generator 110 could be external to the processor 100. The source generator 110 may be implemented with one or multiple hardware or software modules and creates graphic contents or provides the input image stream to the ISC 180. The ISC 180 can be arranged to collect and overlap graphic contents of the input image stream to form each frame of the output image stream and transmit the output image stream to the display controller 140. The ISC 180 is also able to obtain information about a frame rate of the input image stream and the refresh rate selection controller 120 can then select a refresh rate suitable for the frame rate. In one embodiment, the ISC 180 monitors the frame rate of the input image stream and immediately/intermittently notifies the refresh rate selection controller 120 of the monitored frame rate.

Preferably but not necessarily, the refresh rate selection controller 120 can select a refresh rate that is close or identical to the detected frame rate. More specifically, if the ISC 180 detects that the input image stream has a low frame rate, the refresh rate selection controller 120 can select a low refresh rate of all the refresh rates that the display panel 300 is operable at that is close or identical to the detected low frame rate. Also, if the ISC 180 detects that the input image stream has a high frame rate, the refresh rate selection controller 120 will select a high refresh rate of all the refresh rates that the display panel 300 is operable at that is close or identical to the detected high frame rate.

It is noted that the processor 100 may perform a frame rate conversion on an original image stream to generate the input image stream. The frame rate conversion can be implemented by a frame rate converter in the processor 100 or by software running on the processor 100. The ISC 180 can also monitor the converted frame rate and notify the refresh rate selection controller 120 of the converted frame rate (i.e. the frame rate of the input image stream).

In an example, to refresh the display panel with the refresh rate of 120 Hz, the frame rate may be ranged from 60 fps-120 fps. In other words, a minimum requirement on the frame rate in implementing the refreshing at 120 Hz can be 60 fps. The minimum requirement may be generated by some applications that limit the frame rate of the input image stream of the processor 100. For example, an application such as a 3D game application may itself limit the input image stream to be a specific frame rate such as 30 fps.

When the refresh rate selection controller 120 selects the refresh rate of 120 Hz, the frame rate of the input stream can be monitored to see whether it is greater than 60 fps or not. If the frame rate is monitored to be less than 60 fps, then the refresh rate selection controller 120 can decrease the refresh rate to be 60 Hz.

Figure 3:
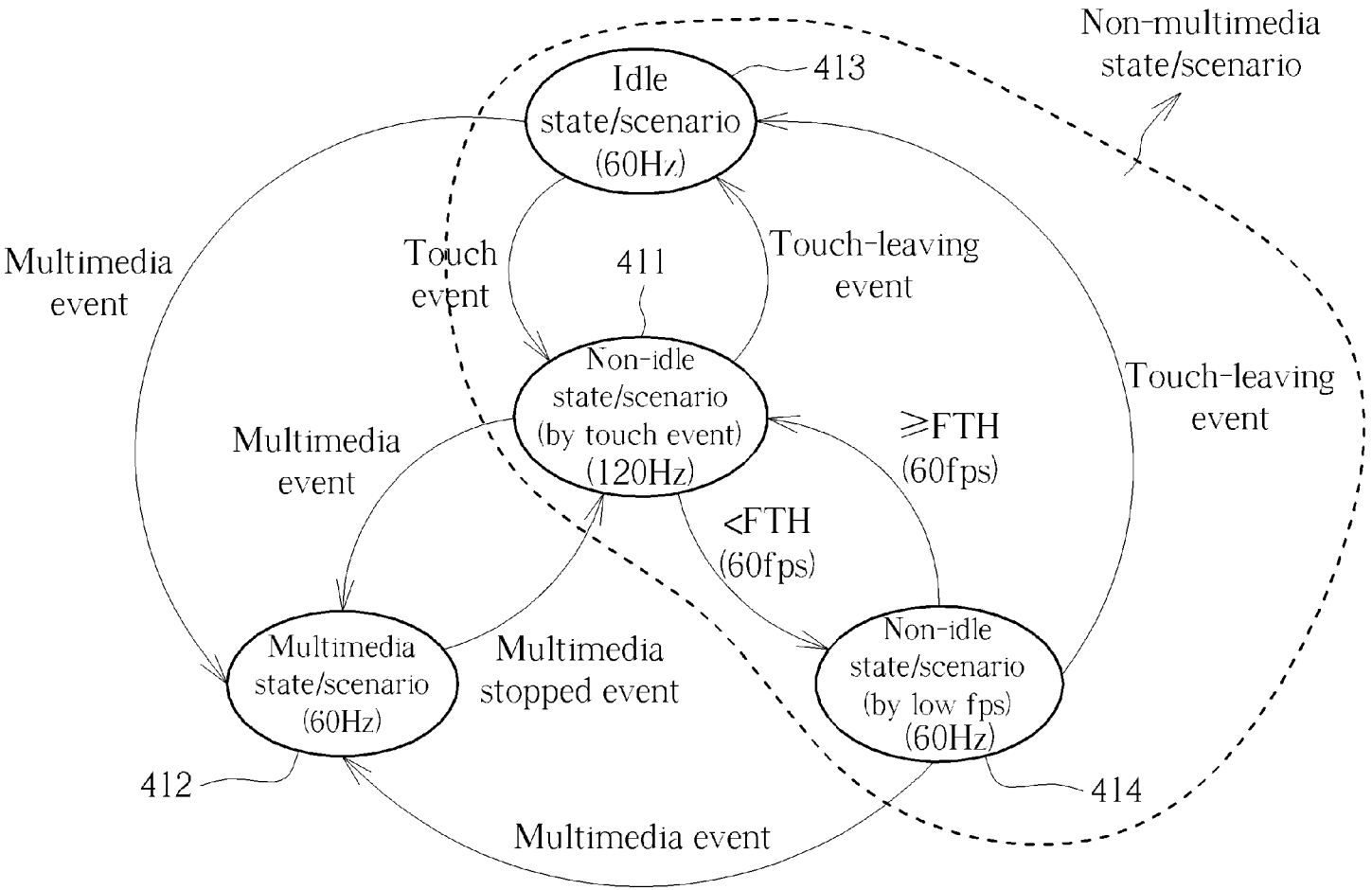
FIG. 3 illustrates a possible implementation of frame rate switching mechanism according to one embodiment of the present invention.

In an example for explanation only, after the refresh rate is selected to be 120 Hz, e.g., in state/scenario 411 of FIG. 3, in response to a touch event, a timing control signal such as a TE signal can trigger the source generator 110 in the processor 100 to create the input image stream having the frame rate of 120 fps or create the graphic contents at a speed that can catch up the forming of the output image stream at 120 fps. This is under an assumption that the source generator 110 has a potential to provide the input image stream of 120 fps or able to have the output image stream formed at 120 fps.

If the source generator 110 can generate the input image stream equal to or greater than 60 fps or the speed at which the source generator 110 creates the graphic contents can catch up the forming of the output image stream at 60 fps, indicating that the monitored frame rate of the input stream rate to be equal to or greater than 60 fps, the processor 100 can be maintained in state/scenario 411.

However, if the source generator 110 is unable to generate the input image stream equal to or greater than 60 fps or the speed at which the source generator 110 creates the graphic contents fails to catch up the forming of the output image stream equal to or greater than 60 fps, the processor 100 cannot be maintained in state/scenario 411 anymore and may be transition to a state/scenario corresponding to a lower refresh rate, such as the state/scenario 414.

In other words, when the refresh rate selection controller 120 selects the refresh rate of 120 Hz, but the ISC 180 monitors the frame rate of the image stream is below 60 fps, a rate monitoring/limitation event can occur, which triggers the processor 100 to transition to a non-idle state/scenario that makes the refresh rate selection controller 120 selects a refresh rate lower than 120 Hz such as 60 Hz.

Similarly, if the refresh rate selection controller 120 selects the refresh rate of 60 Hz in a certain non-idle state/scenario, but the ISC 180 monitors the frame rate of the image stream is below 30 fps, a rate monitoring/limitation event can also occur, which triggers the processor 100 to transition to a non-idle state/scenario that causes the refresh rate selection controller 120 to select a lower refresh rate such as 30 Hz.

In summary, when a minimum requirement (such as 60 fps for example) cannot be met, the rate monitoring/limitation events can occur to trigger the processor 100 to transition to a state/scenario which corresponds to a lower refresh rate.

On the other hand, the rate monitoring/limitation event can also cause the refresh rate selection controller 120 to select a higher refresh rate. For example, if the refresh rate selection controller 120 selects the refresh rate of 60 Hz in a non-idle state/scenario, and the ISC 180 monitors the frame rate of the input image stream can be always higher than or equal to 60 fps, the rate monitoring/limitation event can occur to trigger the processor 100 to transition to another non-idle state/scenario which corresponds to a higher refresh rate, such as 120 Hz. Accordingly, the refresh rate selection controller 120 selects the refresh rate of 120 Hz.

In the embodiments, since the refresh rate selection controller 120 can select a refresh rate according to frame rate monitoring/limitation events, the efficiency in use of a supply power to the electronic device can be enhanced.

Switching Mechanism A

A possible implementation of refresh rate switching mechanism according to one embodiment of the present invention is illustrated in FIG. 3.

In this embodiment, the processor 100 has four main types of states/scenarios, including a non-idle state/scenario (caused by the touch event) 411, a multimedia state/scenario 412, one or more non-multimedia states/scenarios which may include an idle state/scenario 413 and one or more non-idle states/scenarios 411 and 414.

In this embodiment the display panel 300 can be selectively refreshed with 60 Hz and 120 Hz. The multimedia state/scenario 412, the idle state/scenario 413 and the non-idle state/scenario 414 may correspond to lower refresh rates of the display panel 300, i.e., 60 Hz. On the other hand, the non-idle state/scenario 411 may correspond to relatively higher refresh rate of the display panel 300, i.e., 120 Hz The one or more non-idle states/scenarios 411 and 414 can be caused by different rate monitoring/limitation events and/or a touch event. Specifically, the non-idle state/scenario 411 corresponds to one or more relatively higher refresh rates that the display panel 300 is operable at, such as 120 Hz, which can be usable in reducing the motion blur. The non-idle state/scenario 414 may be caused by either or both of a touch event and a rate monitoring/limitation event indicating a monitored/limited frame rate of 120 Hz. On the other hand, the non-idle state/scenario 414 corresponds to one or more relatively lower refresh rates that the display panel 300 is operable at, such as 60 Hz, which can be reduce power consumption.

The idle state/scenario 413 can be caused by a touch-leaving event. In addition, when the electronic device 10 is operated in standby mode, the processor 100 could be in the idle state/scenario 413. In the idle state/scenario 413, the refresh rate selection controller 120 selects a relatively lower refresh rate or the lowest refresh rate from the refresh rates that the display panel 300 is operable at. In this embodiment, the refresh rate selection controller 120 selects the refresh rate of 60 Hz in the idle state/scenario 413.

With respect to the transition between the idle state/scenario 413 and the non-idle state/scenario 411, once a touch event occurs, the processor 100 can transition from the idle state/scenario 413 to the non-idle state/scenario 411. In the non-idle state/scenario 411, the refresh rate selection controller 120 selects a higher refresh rate or the highest refresh rate from the refresh rates supported by the display panel 300 in order to reduce possible motion blur in the image stream to be presented. In this embodiment, the refresh rate selection controller 120 selects the refresh rate of 120 Hz in the non-idle state/scenario 411. After the processor 100 transition to the non-idle state/scenario 411, a touch-leaving/idle event could cause the processor 100 to return back to the idle state/scenario 413 again, in which the refresh rate selection controller 120 again selects the refresh rate of 60 Hz to reduce power consumption.

With respect to transition between the multimedia states/scenarios and the non-multimedia states/scenarios, multimedia events caused by the above-mentioned operations could cause the processor 100 to transition to the multimedia state/scenario 412 from one or more of the other states/scenarios. In the multimedia state/scenario 412, the refresh rate selection controller 120 can select one or more corresponding refresh rate predetermined to be suitable for handling the multimedia events. In this embodiment, the refresh rate selection controller 120 always selects the refresh rate of 60 Hz in the multimedia state/scenario 412.

In other embodiments, a refresh rate can be selected from multiple refresh rates such depending on to the type of the multimedia event or relevant details. For example, a refresh rate can be selected from multiple refresh rates 30 Hz and 60 Hz when the display panel 300 is capable to be selectively refreshed with 30 Hz, 60 Hz and 120 Hz.

Further, a multimedia stopped event could trigger the processor 100 to leave the multimedia state/scenario 412 and transition to one or more of the non-multimedia states/scenarios, e.g., the non-idle state/scenario 411. At this time, the refresh rate selection controller 120 selects the refresh rate of 120 Hz to be prepared for a possible touch event. In an alternative embodiment, a multimedia stopped event could trigger the processor 100 to transition to the non-idle state/scenario 414, instead.

With respect to transition between the non-idle states/scenarios 411 and 414, it can be triggered by frame rate monitoring/limitation events. For example, these events may indicate a monitored/limited frame rate FTH>=60 Hz or not. Taking frame rate monitoring events for example, when the processor 100 is in the non-idle state/scenario 411, the ISC 180 can continually monitor the frame rate of the input image stream and the refresh rate selection controller 120 can determine whether the frame rate of the input image stream is lower than a frame rate threshold FTH. In one embodiment, the frame rate threshold FTH is 60 fps.

If it is detected that the frame rate of the input image stream is lower than 60 fps, the rate monitoring/limitation event occurs, which triggers the processor 100 to transition to the non-idle state/scenario 414. In the non-idle state/scenario 414, the refresh rate selection controller 120 selects a refresh rate of 60 Hz. This implementation allows the source generator 110 creates graphic contents at a speed that can catch up the frame rate needed for refreshing the display panel 300 at the selected refresh rate. Hence, when the rate monitoring/limitation event (<FTH) occurs, the processor 100 can be triggered to transition to the non-idle state/scenario 414 and select the refresh rate to be 60 Hz.

On the other hand, once the processor 100 is in the non-idle state/scenario 414, it can still monitor the frame rate of the input image stream. When a monitored frame rate (or a limited frame rate in other limitation events) is higher than or equal to 60 fps for a period, the processor 100 can transition back to the non-idle state/scenario 411 and again direct the driving device 200 to drive the display panel 300 with the refresh rate of 120 Hz.

With respect to the transition between the non-idle state/scenario 411 or 414 and the idle state/scenario 413, the processor 100 may stay in the non-idle state/scenario 411 or state/scenario 414 as along as a touch event occurs. However, once a touch-leaving/idle event occurs, the processor 100 will leave the non-idle state/scenario 411 or the non-idle state/scenario 414, and transition to the idle state/scenario 413.

Switching Mechanism B

Figure 4:
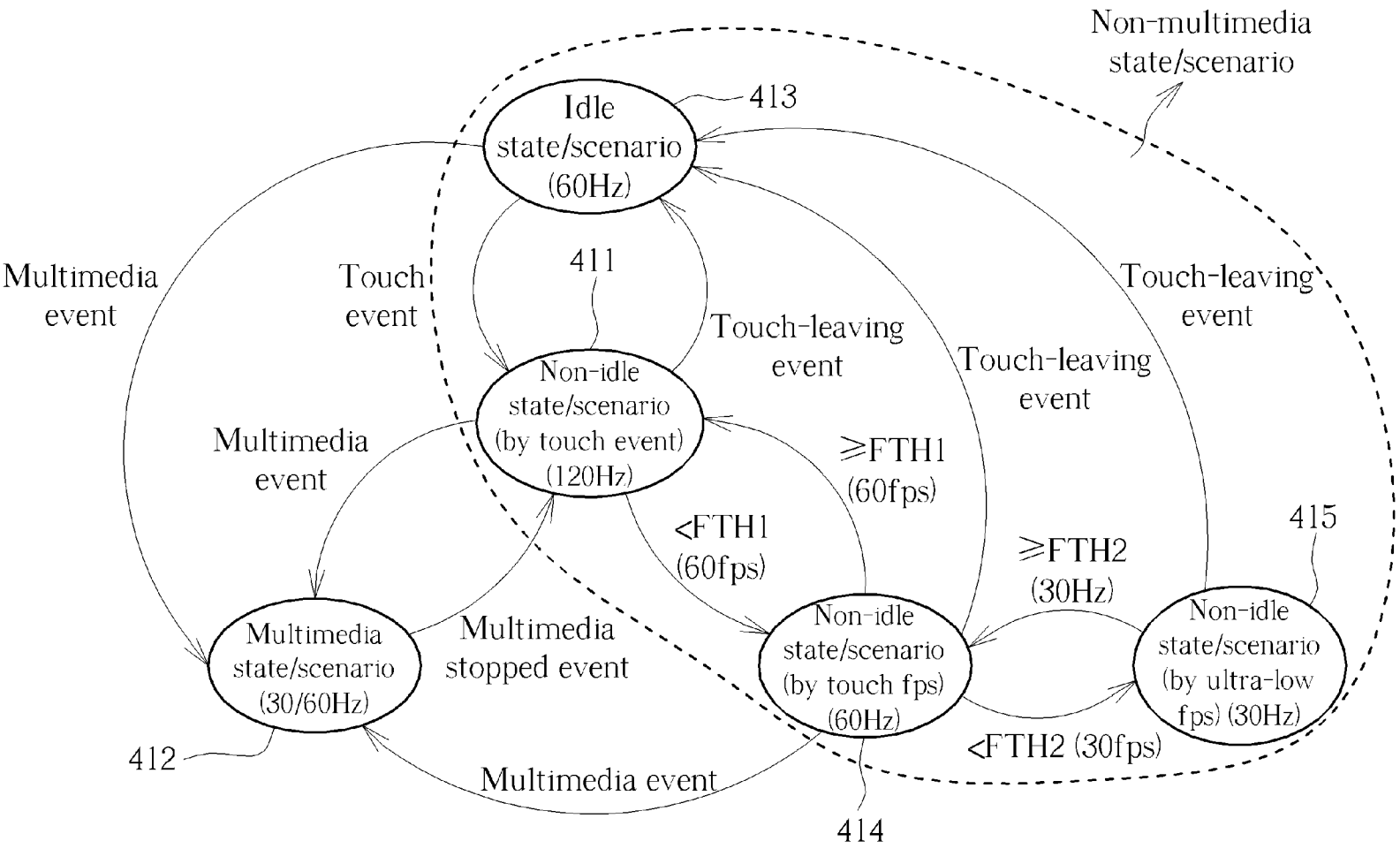
FIG. 4 illustrates another possible implementation of frame rate switching mechanism according to one embodiment of the present invention.

Another possible implementation of refresh rate switching mechanism according to one embodiment of the present invention is illustrated in FIG. 4. In this embodiment the display panel 300 can be selectively refreshed with 30 Hz, 60 Hz and 120 Hz. Compared to the embodiment in FIG. 3, there is an extra non-idle state/scenario 415. The difference between the non-idle states/scenarios 415 and 414 is that the refresh rate is selected respectively to be 30 Hz and 60 Hz, caused by different monitoring/limitation on the frame rate of the input image stream.

Similar to FIG. 3, when a touch event occurs, the processor 100 can transition to the non-idle state/scenario 411 and the refresh rate selection controller 120 selects a relatively higher or the highest refresh rate, such as 120 Hz that the display panel 300 is operable at. However, when a rate monitoring/limitation event indicating a monitored or limited frame rate lower than a first threshold (<FTH1) occurs, the processor 100 can transition to the non-idle state/scenario 414 and the refresh rate selection controller 120 selects a refresh rate corresponding to the non-idle state/scenario 414, such as a lower refresh rate, 60 Hz. Similarly, in the non-idle state/scenario 414, when a rate monitoring/limitation event indicating a monitored or limited frame rate lower than a second threshold (<FTH2) occurs, and a touch-leaving/idle event still does not occur, the processor 100 can transition to the non-idle state/scenario 415 and the refresh rate selection controller 120 selects a refresh rate corresponding to the non-idle state/scenario 415, such as a lowest refresh for the refreshing of the display panel 300, 30 Hz.

On the other hand, in either the non-idle state/scenario 414 or the non-idle state/scenario 415, a rate monitoring/limitation event indicating a monitored/limited frame rate greater than the first threshold (≥FTH1) or a rate monitoring/limitation event indicating a monitored/limited frame rate greater than the first threshold (≥FTH2) may occur. The processor 100 or the electronic device 10 can attempt to increase the refresh rate to be 120 Hz or 60 Hz so as adapt to the increase of the monitored frame rate.

As mentioned above, the refresh rate selection controller 120 can dynamically select one from the plurality refresh rates without a direct setting of the refresh rate by a user. Moreover, the refresh rate selection controller 120 can select a suitable refresh rate for the current state or current usage scenario caused by different triggering events such as power-related event, touch-related event, and/or multimedia-related event. In comparison, the conventional art does not allow the refresh rate of a display panel to be dynamically changed or adjusted or user manual setting needs to be involved. Consequently, the embodiments of the present disclosure can meet various design requirements such as minimizing power consumption in refreshing the display panel, increasing power efficiency or reducing waste of power consumption, and/or enhancing user's visual experience.

Reference throughout this specification to "one embodiment", "an embodiment", "one example" or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Circuits/modules in the embodiments of the invention may include function that may be implemented as software executed by a processor, hardware circuits or structures, or a combination of both. The processor may be a general-purpose or dedicated processor. The software may comprise programming logic, instructions or data to implement certain function for an embodiment of the invention. The software may be stored in a medium accessible by a machine or computer-readable medium, such as read-only memory (ROM), random-access memory (RAM), magnetic disk (e.g., floppy disk and hard drive), optical disk (e.g., CD-ROM) or any other data storage medium. In one embodiment of the invention, the media may store programming instructions in a compressed and/or encrypted format, as well as instructions that may have to be compiled or installed by an installer before being executed by the processor. Alternatively, an embodiment of the invention may be implemented as specific hardware components that contain hard-wired logic, field programmable gate array, complex programmable logic device, or application-specific integrated circuit, for performing the recited function, or by any combination of programmed general-purpose computer components and custom hardware component.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A processor for use in an electronic device capable of displaying, having capability of switching a refresh rate for refreshing a display panel, comprising:

an image stream consumer circuit, configured to receive an input image stream and output an output image stream;

a refresh rate selection controller circuit, configured to select a refresh rate from a plurality of refresh rates in response to monitoring of a current state/scenario, wherein the processor dynamically transitions between different states/scenarios in response to different triggering events, wherein the states/scenarios comprise one or more multimedia states/scenarios, non-multimedia states/scenarios, and a low power state/scenario; and a display controller circuit, configured to receive the output image stream from the image stream consumer circuit and transmit image data in the output image stream to a driving device, and, in response to the selecting by the refresh rate selection controller circuit, control the driving device to refresh the display panel with the selected refresh rate, wherein, in dynamically transitioning between different states/scenarios, the processor is capable of transitioning from the low power state/scenario to one of the one or more non-multimedia states/scenarios and then to one of the one or more multimedia states/scenarios in response to simultaneous occurrence of a non-low power event and a multimedia event, wherein, in response to a plurality of different low power levels, the processor transitions to a plurality of different low power states/scenarios, wherein, in response to a plurality of different types of multimedia events and a plurality of different frame rates of the input image stream, the processor transitions to a plurality of different multimedia states/scenarios, and wherein the display controller circuit controls the driving device to refresh the display panel at the plurality of refresh rates corresponding to the different low power states/scenarios and the different multimedia states/scenarios.

2. The processor of claim 1, wherein each of the states/scenarios corresponds to one or more refresh rates of the refresh rates, and the refresh rate selection controller circuit selects one of the one or more refresh rates to which a current state/scenario corresponds.

3. The processor of claim 2, wherein the triggering events comprise at least one of a low power event, a non-low power event, one or more multimedia events, and/or one or more multimedia stopped events, which trigger the processor to transition between the at least one of the low power state/scenario, the one or more multimedia states/scenarios, and the one or more non-multimedia states/scenarios.

4. The processor of claim 3, wherein regardless which one of the non-multimedia states/scenarios the processor is originally in, if any one of the one or more multimedia events occurs, the occurring multimedia event triggers the processor to transition to the one of the one or more multimedia states/scenarios.

5. The processor of claim 3, wherein when the processor is originally in one of the one or more multimedia states/scenarios, if any one of the one or more multimedia-stopped events occurs, the occurring multimedia-stopped event trigger the processor to leave the one of the one or more multimedia states/scenarios and to transition to one of the one or more non-multimedia states/scenarios.

6. The processor of claim 3, wherein the one or more multimedia events comprise at least one of a video playback event, a video recording event, and a camera preview event.

7. The processor of claim 3, wherein the one or more multimedia states/scenarios correspond to a predetermined refresh rate, and when any of the one or more multimedia events occurs, the refresh rate selection controller s circuit elects the predetermined refresh rate to be the selected refresh rate.

8. The processor of claim 3, wherein the one or more multimedia states/scenarios correspond to a plurality of predetermined refresh rates, and when one of the one or more multimedia event occurs, the refresh rate selection controller circuit selects one of the predetermined refresh rates to be the selected refresh rate according to a frame rate of the input image stream.

9. The processor of claim 8, wherein the processor further comprises a frame rate converter circuit, for converting an original image stream to be the input image stream, wherein the frame rate of the input image stream is converted from a frame rate of the original image stream.

10. The processor of claim 8, wherein the refresh rate selection controller circuit obtains the frame rate of the input image stream from information provided by one of one or more multimedia processing circuits or a calculation result by the image stream consumer circuit.

11. The processor of claim 3, wherein the processor further comprises one or more multimedia processing circuits, each configured to inform the refresh rate selection controller circuit of one of the one or more multimedia events and the one or more multimedia-stopped events.

12. The processor of claim 11, wherein the one or more multimedia processing circuits comprise a decoder circuit configured to inform the refresh rate selection controller circuit of a video playback event when the decoder circuit is executing a decoding process.

13. The processor of claim 11, wherein the one or more multimedia processing circuits comprise an encoder circuit configured to inform the refresh rate selection controller circuit of a video recording event when the encoder circuit is executing an encoding process.

14. The processor of claim 11, wherein the one or more multimedia processing circuits comprise an image sensor processor (ISP) circuit configured to inform the refresh rate selection controller circuit of at least one of a camera preview event.

15. The processor of claim 3, wherein the refresh rate selection controller circuit determines whether a multimedia event occurs according to a frame rate of the input image stream calculated by the image stream consumer circuit and whether the input image stream is encoded in a specific color format.

16. The processor of claim 15, wherein when the input image stream is encoded in the specific color format and has a stable non-zero frame rate, the refresh rate selection controller circuit determines the multimedia event to occur.

17. The processor of claim 3, wherein regardless which one of one or more multimedia states/scenarios, and one or more non-multimedia states/scenarios the processor is originally in, when the low power event occurs, it triggers the processor to transition to the low power state/scenario.

18. The processor of claim 3, wherein the low power state/scenario corresponds to a predetermined refresh rate of the refresh rates, and when the processor is in the low power state/scenario, the refresh rate selection controller circuit selects the predetermined refresh rate to be the selected refresh rate.

19. The processor of claim 18, wherein the predetermined refresh rate is lower than at least one other refresh rates of the refresh rates.

20. The processor of claim 19, wherein the predetermined refresh rate is the lowest refresh rate of the refresh rates.

21. The processor of claim 3, wherein the refresh rate selection controller circuit is informed by a power management circuit of the low power event when the power management circuit detects the electronic device is at a low power level.

22. The processor of claim 2, wherein the one or more non-multimedia states/scenarios comprise an idle state/scenario and one or more non-idle states/scenarios.

23. The processor of claim 22, wherein the triggering events comprise at least one of a touch event, a touch-leaving/idle event, and/or one or more rate monitoring/limitation events, which trigger the processor to transition between the idle state/scenario and the one or more non-idle states/scenarios.

24. The processor of claim 23, wherein the touch event triggers the processor transition from the idle state/scenario to the one or more non-idle states/scenarios.

25. The processor of claim 24, wherein when the processor is originally in the idle state/scenario, when the touch event occurs, the occurring touch event triggers the processor to leave the idle state/scenario and transition to a first one of the one or more non-idles state/scenario.

26. The processor of claim 25, wherein the first non-idle state/scenario corresponds to a predetermined refresh rate which is a highest one of the one or more refresh rate which the one or more non-idle states/scenarios corresponding to, respectively.

27. The processor of claim 23, wherein the touch-leaving/idle event triggers the processor transition from the non-idle states/scenarios to the idle state/scenario.

28. The processor of claim 23, wherein the one or more rate monitoring/limitation events trigger the processor to transition between the one or more non-idle events.

29. The processor of claim 23, wherein no matter which one of the non-idle states/scenarios the processor is originally in, when the touch-leaving/idle event occurs, the occurring touch-leaving/idle event or idle event triggers the processor to transition to the idle state/scenario.

30. The processor of claim 23, wherein the idle state/scenario corresponds to a predetermined refresh rate of the refresh rates, and when the processor is in the idle state/scenario, the refresh rate selection controller circuit selects the predetermined refresh rate to be the selected refresh rate.

31. The processor of claim 30, wherein the predetermined refresh rate is lower than at least one other refresh rate of the refresh rates.

32. The processor of claim 31, wherein the predetermined refresh rate is the lowest refresh rate of the refresh rates.

33. The electronic device of claim 23, wherein the refresh rate selection controller circuit is informed by at least one touch sensor module of the touch event or the touch-leaving/idle event.

34. The processor of claim 23, wherein the refresh rate selection controller circuit obtains information from the image stream consumer circuit about the one or more rate monitoring/limitation events that indicates a frame rate of the input image stream.

35. The processor of claim 23, wherein the refresh rate selection controller circuit obtains from a source generator currently running by the processor information about the one or more rate monitoring/limitation events that indicates a limitation condition of the refresh rate.

36. The processor of claim 23, wherein when the input image stream has a stable frame rate lower than a threshold frame rate, the refresh rate selection controller circuit determines the idle event to occur.

37. The processor of claim 36, wherein the refresh rate selection controller circuit obtains information from the image stream consumer circuit about the frame rate of the input image stream.

38. The processor of claim 1, wherein the refresh rate selection controller circuit is informed by one or more system module internal to the processor of the different triggering events.

39. The processor of claim 1, wherein the refresh rate selection controller circuit is informed by one or more system modules external to the processor of the different triggering events.

40. The processor of claim 1, wherein the refresh rate selection controller circuit obtains from the image stream consumer circuit about information of the input image stream and determines whether any and which of the triggering events is occurring according to the information.

41. The processor of claim 1, wherein if the selected refresh rate is changed, a frequency of a timing control signal communicating the display panel and the driving device is adjusted to be equal to the selected to the selected refresh rate.

42. The processor of claim 41, wherein if the selected refresh rate is changed, a data transmission rate over an interface between the display controller circuit and the driving device is changed correspondingly.

43. An electronic device capable of displaying, having capability of switching a refresh rate for refreshing a display panel, comprising:

a display panel, capable of display frames with a plurality of a refresh rates;

a processor, configured to dynamically transition between different states/scenarios in response to different triggering events and select a refresh rate from the plurality of refresh rates in response to monitoring of a current state/scenario, wherein the states/scenarios comprise one or more multimedia states/scenarios; and a driving device, coupled between the processor and the display panel, controlled by the processor to refresh the display panel with the selected refresh rate, wherein the processor dynamically transitions between different states/scenarios by determining whether a multimedia event occurs according to:

a frame rate of an input image stream, and whether the input image stream is encoded in a predetermined color format, wherein, in response to a plurality of different low power levels, the processor transitions to a plurality of different low power states/scenarios, wherein, in response to a plurality of different types of multimedia events and a plurality of different frame rates of the input image stream, the processor transitions to a plurality of different multimedia states/scenarios, and wherein the display controller circuit controls the driving device to refresh the display panel at the plurality of refresh rates corresponding to the different low power states/scenarios and the different multimedia states/scenarios.

44. The electronic device of claim 43, wherein each of the states/scenarios corresponds to one or more refresh rates of the refresh rates, and the processor selects one of the one or more refresh rates to which a current state/scenario corresponds.

45. The electronic device of claim 44, wherein the states/scenarios comprise a low power state/scenario, one or more non-multimedia states/scenarios, or a combination thereof in addition to or in lieu of the one or more multimedia states/scenarios.

46. The electronic device of claim 45, wherein the triggering event comprise at least one of a low power event, a non-low power event, one or more multimedia events, and/or one or more multimedia stopped events, which trigger the processor to transition between the at least one of the low power state/scenario, the one or more multimedia states/scenarios, and the one or more non-multimedia states/scenarios.

47. The electronic device of claim 45, wherein the one or more non-multimedia states/scenarios comprise an idle state/scenario and one or more non-idle states/scenarios.

48. The electronic device of claim 47, wherein the triggering event comprise at least one of a touch event, a touch-leaving/idle event, and/or one or more rate monitoring/limitation events, which trigger the processor to transition between the idle state/scenario and the one or more non-idle states/scenarios.

49. The electronic device of claim 48, wherein the touch event triggers the processor to transition from the idle states/scenarios to the one or more non-idle states/scenarios.

50. The electronic device of claim 48, wherein the touch-leaving/idle event triggers the processor to transition from the non-idle states/scenarios to the idle state/scenario.

51. The electronic device of claim 48, wherein the one or more rate monitoring/limitation events trigger the processor to transition between the one or more non-idle states/scenarios.

52. The electronic device of claim 43, wherein the processor is informed by one or more system modules internal to the processor of the different triggering events.

53. The electronic device of claim 43, wherein the processor is informed by one or more system modules external to the processor of the different triggering events.

54. The electronic device of claim 43, wherein the processor obtains from an image stream consumer circuit about information of the input image stream and determines whether any and which of the triggering events is occurring according to the information.

55. A processor for use in an electronic device capable of displaying, having capability of switching a refresh rate for refreshing a display panel, comprising:

a refresh rate selection controller circuit, configured to dynamically adjust a refresh rate for refreshing the display panel when a triggering event occurs; and a display controller circuit, configured to control a driving device to refresh the display panel with the adjusted refresh rate, wherein the triggering event comprises a multimedia event, wherein the refresh rate selection controller circuit dynamically adjusts the refresh rate by determining whether the multimedia event occurs according to:

a frame rate of an input image stream, and whether the input image stream is encoded in a predetermined color format, wherein, in response to a plurality of different low power levels, the processor transitions to a plurality of different low power states/scenarios, wherein, in response to a plurality of different types of multimedia events and a plurality of different frame rates of the input image stream, the processor transitions to a plurality of different multimedia states/scenarios, and wherein the display controller circuit controls the driving device to refresh the display panel at a plurality of different refresh rates corresponding to the different low power states/scenarios and the different multimedia states/scenarios.

56. The processor of claim 55, wherein the triggering event further comprises a power-related triggering event which is a detected event indicating that the electronic device is at a low power level or a request for lowering power consumption of the electronic device.

57. The processor of claim 56, wherein the processor is informed by a power management circuit of the power-related triggering event.

58. The processor of claim 55, wherein the refresh rate selection controller circuit adjusts the refresh rate by selecting one refresh rate from the plurality of refresh rates.

59. An electronic device capable of displaying, having capability of switching a refresh rate for refreshing a display panel, comprising:

a display panel, capable of displaying frames;

a processor, configured to dynamically adjust a refresh rate for refreshing the panel when a triggering event occurs; and a driving device, coupled between the processor and the display panel, controlled by the processor to refresh the display panel with the adjusted refresh rate, wherein the triggering event comprises a multimedia event, wherein the processor dynamically adjusts the refresh rate by determining whether the multimedia event occurs according to:

a frame rate of an input image stream, and whether the input image stream is encoded in a predetermined color format, wherein, in response to a plurality of different low power levels, the processor transitions to a plurality of different low power states/scenarios, wherein, in response to a plurality of different types of multimedia events and a plurality of different frame rates of the input image stream, the processor transitions to a plurality of different multimedia states/scenarios, and wherein the display controller circuit controls the driving device to refresh the display panel at a plurality of different refresh rates corresponding to the different low power states/scenarios and the different multimedia states/scenarios.

60. The electronic device of claim 59, wherein the triggering event further comprises a power-related triggering event which is a detected event indicating that the electronic device is at a low power level or a request for lowering power consumption of the electronic device.

61. The electronic device of claim 60, wherein the processor is informed by a power management circuit of the power-related triggering event.

62. The electronic device of claim 59, wherein the processor adjusts the refresh rate by selecting one refresh rate from the plurality of refresh rates.

63. A processor for use in an electronic device capable of displaying, having capability of switching a refresh rate for refreshing a display panel, comprising:

an image stream consumer circuit, configured to receive an input image stream and output an output image stream;

a refresh rate selection controller circuit, configured to select a refresh rate from a plurality of refresh rates in response to different triggering events, the different triggering events including at least one of a multimedia event, a touch event, and a frame rate monitoring/limitation event for the input image stream; and a display controller circuit, configured to receive the output image stream from the image stream consumer circuit and transmit image data in the output image stream to a driving device, and, in response to the selection by the refresh rate selection controller circuit, the display controller circuit further configured to control the driving device to refresh the display panel with the selected refresh rate, wherein the refresh rate selection controller circuit dynamically adjusts the refresh rate by determining whether the multimedia event occurs according to:

a frame rate of the input image stream, and whether the input image stream is encoded in a predetermined color format, wherein, in response to a plurality of different low power levels, the processor transitions to a plurality of different low power states/scenarios, wherein, in response to a plurality of different types of multimedia events and a plurality of different frame rates of the input image stream, the processor transitions to a plurality of different multimedia states/scenarios, and wherein the display controller circuit controls the driving device to refresh the display panel at the plurality of different refresh rates corresponding to the different low power states/scenarios and the different multimedia states/scenarios.

* * * * *